US007489788B2

(12) United States Patent
Leung et al.

(10) Patent No.: US 7,489,788 B2
(45) Date of Patent: Feb. 10, 2009

(54) RECORDING A THREE DIMENSIONAL AUDITORY SCENE AND REPRODUCING IT FOR THE INDIVIDUAL LISTENER

(75) Inventors: Johahn Leung, Sydney (AU); Craig Jin, Sydney (AU); Simon Carlile, Sydney (AU); Andre Van Schaik, Sydney (AU)

(73) Assignee: Personal Audio Pty Ltd (AU)

( * ) Notice: Subject to any disclaimer, the term of this patent is extended or adjusted under 35 U.S.C. 154(b) by 222 days.

(21) Appl. No.: 10/490,591

(22) PCT Filed: Jul. 18, 2002

(86) PCT No.: PCT/AU02/00960

§ 371 (c)(1),
(2), (4) Date: Nov. 15, 2004

(87) PCT Pub. No.: WO03/009639

PCT Pub. Date: Jan. 30, 2003

(65) Prior Publication Data

US 2005/0080616 A1 Apr. 14, 2005

(30) Foreign Application Priority Data

Jul. 19, 2001 (AU) ..... PR6475

(51) Int. Cl.
*H04R 3/00* (2006.01)

(52) U.S. Cl. ..... 381/92

(58) Field of Classification Search ..... 381/92, 381/26, 23, 1, 98, 94.3, 17–19, 310, 309, 381/122, 91, 355; 704/200.1, 225–227
See application file for complete search history.

(56) References Cited

U.S. PATENT DOCUMENTS 3,348,195 A * 10/1967 Spandock ..... 367/125

(Continued)

FOREIGN PATENT DOCUMENTS

EP 0 505 949 B1 12/1995

(Continued)

OTHER PUBLICATIONS

International Search Report of Oct. 15, 2002.

*Primary Examiner*—Vivian Chin
*Assistant Examiner*—Lun-See Lao
(74) *Attorney, Agent, or Firm*—Greenberg Traurig, LLP

(57) ABSTRACT

A system for recording and reproducing a three dimensional auditory scene for individual listeners includes one or more microphone arrays (2 and 16); a support (3) for holding, moving the microphone array and also for attaching other devices (14); a data storage and encoding device (9); a control interface (13), and a processor and decoding device (10). The microphones in the microphone array (2) preferably have strong directional characteristics. The microphone array support mount (4) can support one or more physical structures (5) to provide directional acoustic filtering. The directional microphone array is electrically connected via a lead (8) to the sound encoding processor (9) and sound decoding processor (10). As the directional microphone array has acoustically directional properties, these properties can be adjusted using signal processing methods to match the acoustics of the external ears of the individual listener and thus result in a perceptually accurate recording and reproduction of a three dimensional auditory scene for the individual listener.

25 Claims, 4 Drawing Sheets

Dashed boxes represent optional steps.

U.S. PATENT DOCUMENTS 4,817,149 A * 3/1989 Myers ..... 381/1
4,853,963 A * 8/1989 Bloy et al. ..... 704/225
5,535,300 A * 7/1996 Hall et al. ..... 704/227
5,715,319 A * 2/1998 Chu ..... 381/26
5,717,764 A * 2/1998 Johnston et al. ..... 381/2
5,848,391 A * 12/1998 Bosi et al. ..... 704/200.1
6,006,179 A 12/1999 Wu et al. ..... 704/222
6,603,861 B1 * 8/2003 Maisano et al. ..... 381/92
6,625,587 B1 * 9/2003 Erten et al. ..... 706/22
2002/0009203 A1 * 1/2002 Erten ..... 381/92

FOREIGN PATENT DOCUMENTS

WO WO 98/06090 A 2/1998

* cited by examiner

Dashed boxes represent optional steps.

Dashed boxes represent optional steps.

Dashed boxes represent optional steps.

Dashed boxes represent optional steps.

RECORDING A THREE DIMENSIONAL AUDITORY SCENE AND REPRODUCING IT FOR THE INDIVIDUAL LISTENER

FIELD OF THE INVENTION

This invention relates to the recording and reproduction of a three dimensional auditory scene for the individual listener. More particularly, the invention relates to a method of, and equipment for, recording a three dimensional auditory scene and then modifying and processing the recorded sound in order to reproduce the three dimensional auditory scene in virtual auditory space (VAS) in such a manner as to improve the perceptual fidelity of the match between the sound the individual listener would have heard in the original sound field and the reproduced sound.

BACKGROUND OF THE INVENTION

The prior art discloses various methods for recording and reproducing a three dimensional auditory scene for individual listeners. All of these methods use one or more microphones to record the sound.

Some of the prior methods for recording and reproducing a three dimensional auditory scene for individual listeners use a custom arrangement of microphones that depends on the acoustic environment and the particular auditory scene to be recorded. Some of these methods involve setting up "room" or "ambience" microphones away from the direct sound source and playing the sound recorded from these microphones to the listening audience using "surround loudspeakers" placed to the side or back of the listening audience.

Some of the prior art methods for recording and reproducing a three dimensional auditory scene for individual listeners use a specific arrangement of microphones. Some of these methods involve using a M/S or Mid-Side/Mono-Stereo microphone arrangement in which a forward-facing microphone (the Mid/Mono signal) and a laterally-oriented bi-directional or figure-eight microphone (the Stereo signal) are used to record the sound. Other of these methods use two first-order cardiod microphones with approximately 17 cm between the two microphones and crossed-over at an angle of approximately 110° in the shape of the letter 'X' and is often referred to as the ORTF recording technique. Yet another of these methods uses two bi-directional microphones located at the same point and angled at 90° to each other and is often referred to as the Blumlein technique. Another of these methods uses two first order cardiod microphones located at the same point and angled at 90° to each other and is often referred to as the XY recording technique.

Some of the prior art methods for recording and reproducing a three dimensional auditory scene for individual listeners use four separate microphone elements arranged in a tetrahedron inside a single capsule. Three of the four elements are arranged as M/S pairs and are often referred to microphones for recording the X,Y,Z Cartesian directions. The fourth microphone element is an omni-directional microphone often referred to as the W channel. The four microphones are usually positioned at the same location and this microphone arrangement is often referred to as a SoundField microphone or a B-format microphone. The sound recorded from the four microphones is often played over loudspeakers or headphones using a mixing matrix to mix together the sound recorded from the four microphone elements and such a playback system is often referred to as an Ambisonic surround sound system.

Some of the prior art methods for recording and reproducing a three dimensional auditory scene for individual listeners use two microphones usually embedded on opposite ends of a sphere and often flush-mounted with the surface of the sphere and is often referred to as a sphere microphone.

Some of the prior art methods for recording and reproducing a three dimensional auditory scene for individual listeners often use two microphones usually embedded on opposite ends of a sphere and often flush-mounted with the surface of the sphere and two bi-directional microphones usually facing forward that are added to the side of the microphones mounted on the sphere. The sound recorded from the flush-mounted microphone on the sphere and the bi-directional microphone positioned next to it are often added and subtracted to produce sound signals for playback Such a system of microphones is often referred to as a KFM 360 or Bruck system.

Some of the prior art methods for recording and reproducing a three dimensional auditory scene for individual listeners often use a five-channel microphone array and a binaural dummy head. Three of the microphones are often mounted on a single support bar with a distance of 17.5 cm between each microphone. These microphones are often positioned 124 cm in front of the binaural dummy head. The two outside microphones often have a super-cardiod polar characteristic and are often angled 30° off centre. The centre microphone often has a cardiod polar characteristic and faces directly front. The other two microphones, often referred to as the surround microphones, are often omni-directional microphones placed in the ears of a dummy head that is often attached to a torso.

Some of the prior art methods for recording and reproducing a three dimensional auditory scene for individual listeners often use five matched dual-diaphragm microphone capsules mounted on a star-shaped bracket assembly. The arrangements of the microphones on the bracket often match the conventional five loudspeaker set-up, with three microphones at the front closely spaced for the left, centre, and right channels and two microphones at the back for the rear left and rear right channels. The five microphone capsules can often have their polar directivity pattern adjusted independently so that they can have a polar pattern varying from omni-directional to cardiod to figure-of-eight. Some of these methods are referred to as the ICA 5 or the Atmos 5.1 system.

Some of the prior art methods for recording and reproducing a three dimensional auditory scene for individual listeners often use eight hypercardiod microphones arranged equispaced around the circumference of an ellipsoidal or egg-shaped surface in a horizontal plane. Some of these methods use additional microphones with a hemispherical pick-up pattern mounted on the top of the ellipsoid facing upwards and on the bottom facing downward. Some of these methods playback the recorded sounds using loudspeakers position in the direction in which the microphones pointed. Some of these methods are referred to as a Holophone system.

Some of the prior art methods for recording and reproducing a three dimensional auditory scene for individual listeners often use seven microphones mounted on a sphere. Some of these methods often use 5 equal-angle spaced hypercardiod microphones in the horizontal plane plus two highly directional microphones aimed vertically up and down. Some of these methods play the recorded sound to the listening audience using a 7-to-5 mixdown with 5 loudspeakers positioned in the direction in which the 5 equal-angle spaced microphones pointed. Some of these methods are referred to as the ATT apparatus for perceptual sound field reconstruction.

Some of the prior art methods for recording and reproducing a three dimensional auditory scene for individual listeners often use two pairs of microphones mounted on opposite sides of a sphere in the horizontal plane. Some of these methods use microphone positioned at ±80° and ±110° on the sphere. Some of these methods play the recorded sound to the listening audience using loudspeakers positioned at ±30° and ±110° in the horizontal plane. Some of these methods employ methods of inverse filtering in order to best approximate the sound recorded at the microphones using the loudspeakers.

All of these prior art methods have disadvantages associated with them. All of the methods described above, except for the last one, which uses methods of inverse filtering, do not determine the directional acoustic transfer functions of the microphone array as it would be recorded under anechoic sound conditions. All of the methods described above, except for the last one, do not incorporate the directional acoustic transfer functions of the microphone array into a method for correcting or determining the directions of the recorded sound. All of the methods described above do not utilize the head-related transfer functions of the individual listener to modify the recorded sound so that it perceptually optimized for the individual listener. The importance of the last point is critical for this application. Each and every listener has external ears that acoustically filter the sound field in a manner that is slightly different than any other listener's external ears. Psychoacoustic research has shown that these small differences are perceptually discernable to human listeners. Thus, this patent describes an invention that takes these individual differences into consideration and modifies the recorded sound for the individual listener to improve the perceptual fidelity of the match between the original and reproduced sounds. In summary, all of the methods described above do not attempt to individualize the sound recording and generation process for the individual listener.

Several terms related to this invention are defined here.

A microphone mount refers to a physical structure that can support or "mount" several microphones.

A microphone array consists of several microphones that are supported in a microphone mount together with the microphone mount itself In addition, a microphone array may consist of several separate microphone mounts and their corresponding microphones. The collective structure would still be referred to as a microphone array.

A directional acoustic receiver is an acoustic recording device (such as a microphone) that has directional acoustic properties. That is to say, the acoustic impulse response of the acoustic recording device varies with the direction in space of the sound source with respect to the acoustic recording device. A typical example of a directional acoustic receiver is a microphone that has directional properties that arise from two contributions: (i) the microphone itself may have directional properties (e.g., a hypercardiod microphone) and (ii) physical structures near the microphone will acoustically filter the incoming sound (e.g., by acoustic refraction and diffraction) in a manner that depends on the direction of the sound source relative to the microphone. Another example of a directional acoustic receiver is the human external ear. In this case, the directional acoustic properties arise from the acoustic filtering properties of the external ear.

A directional acoustic transfer function refers to the impulse response and/or frequency response of a directional acoustic receiver; the impulse response and/or frequency response describe the pressure transformation from a location in space to the directional acoustic receiver. Generally, there is a directional acoustic transfer function for each direction and/or location in space relative to the directional acoustic receiver. In addition, the directional acoustic transfer function will depend on the environment (walls, tables, people, empty space, etc.) that surrounds the directional acoustic receiver. The term directional acoustic transfer function may refer to an acoustic transfer function recorded in any environment Often, however, the term directional acoustic transfer function refers to an impulse response and/or frequency response measured in the free-field (i.e., anechoic sound condition with no echoes).

A directional microphone array is defined as a microphone array in which some of the individual microphones in the microphone array are directional acoustic receivers. The group of microphones (in the microphone array) that are directional acoustic receivers may collectively describe the directional properties of the sound field (e.g., the incoming direction of acoustic energy in a given frequency band).

Primary microphones refer to directional acoustic receivers (microphones) that form part of a directional microphone array. The primary microphones are typically selected on the basis of specific signal processing issues related to the recording and reproduction of three-dimensional sound. As an example, the primary microphones may be microphones that correspond in some way to the hypothetical external ears of an individual listener.

Secondary microphones refer to directional acoustic receivers (microphones) that form part of a directional microphone array. The secondary microphones generally form a collective set of directional acoustic receivers whose recorded signals characterize the directional aspects of a recorded sound field. For example, the secondary microphones of the directional microphone array may be used collectively to determine the incoming direction of the acoustic energy in narrow frequency bands above approximately 1 kHz and up to the high-frequency limit of human hearing, e.g., 16 to 20 kHz.

A pair of source and target directional acoustic receivers refers to two directional acoustic receivers with a specific and defined geometrical arrangement in space. The geometrical relationship can be hypothetical or can correspond to a real physical structure. The geometrical relationship ensures that once the location and orientation of the source directional acoustic receiver is defined, then the location and orientation of the target directional acoustic receiver is also defined. Generally, the pair of source and target directional acoustic receivers will also have a specific and defined geometrical relationship to a directional microphone array. Therefore, it is typically the case that the pair of source and target directional acoustic receivers together with a directional microphone array are positioned, either hypothetically or in reality, in a sound field such that their geometrical relationship is defined. It may also be the case that either or both of the source and target directional acoustic receivers form a part of the directional microphone array. In any of the above cases, the primary point is that all three objects (the source and target directional acoustic receivers and the directional microphone array) have a defined geometrical relationship to each other. The geometrical arrangement of the target directional acoustic receiver with respect to the source directional acoustic receiver and also with respect to the directional microphone array may vary with time. Nonetheless, for any given short time window, the geometrical arrangement of the target directional acoustic receiver with respect to the source directional acoustic receiver is fixed. The manner in which the pair of source and target directional acoustic receivers is used forms an integral part of their definition, therefore, a brief description is given of their method of use. Generally, the source directional acoustic receiver and the directional microphone array are used to simultaneously record a three-dimensional sound field. The signal recorded by the source directional acoustic receiver is referred to as the recorded source signal. Generally, the recorded source signal is then modified or transformed using the information provided by the sound signals recorded by the directional microphone array. Generally, the objective of the signal transformation is to generate a signal that matches (hypothetically or in reality) the signal that would have been recorded by the target directional acoustic receiver, were the target directional acoustic receiver present in the original sound field and recording simultaneously with the source directional acoustic receiver.

The recorded source signal refers to a signal recorded by the source directional acoustic receiver as defined above.

A directional acoustic receiving array is identified as a separate object from a directional microphone array. A directional acoustic receiving array refers to a subset of the microphones of the directional microphone array. The directional acoustic receiving array is primarily used to determine the sound corresponding to a single direction in space, whereas the directional microphone array is used to determine the sound for every direction in space. By using a subset of the microphones of the directional microphone array as a directional acoustic receiving array and applying methods that are standard in the art of acoustic beam-forming, the directional information derived from the secondary microphones can be improved.

High frequency and low frequency sub-bands of acoustic signals relating to three dimensional audio refer to the frequency division in which the spectral and timing cues, respectively, of the external ears of the listener plays an important role in the human sound externalisation and localization of the acoustic signal. Low frequency sub-bands refer to the frequency bands in which acoustic timing cues are important for human sound externalisation and localisation. High frequency sub-bands refer to the frequency bands in which spectral cues are important for human sound externalisation and localisation. Nominally, the low frequency sub-bands are frequency bands below approximately 5 kHz and the high frequency sub-bands are frequency bands above approximately 5 kHz.

SUMMARY OF THE INVENTION

According to a first aspect of the invention, there is provided a method for recording and reproducing a three dimensional auditory scene for individual listeners, the method including the steps of arranging microphones in a microphone mount such that the microphones together with the microphone mount, referred to as a microphone array, have acoustic properties that vary with the direction of the sound in space;

determining the directional acoustic transfer functions for a number of directions in space for a number of microphones in the microphone array;

determining the directional acoustic transfer functions for a number of directions in space for the left and right external ears of the individual listener;

establishing a relative frame of reference (which may be dynamically changing with time) between the orientation and position of the external ears of the individual listener and the orientation and position of the microphone array in the original sound environment at the time of the recording of the sound field;

recording a three dimensional auditory scene using the microphone array, modifying the sound recorded by the microphone array using information derived from the differences between the directional acoustic transfer functions of the microphones in the microphone array and the directional acoustic transfer functions of the external ears of the individual listener and also directional information derived from the recorded microphone signals and the frame of reference described above, in order to perceptually improve the estimate of the sound that would have been present at the ears of the individual listener, were the individual listener to have been present at the position of the microphone array and facing a specific direction in the original sound environment;

optionally identifying and filtering any additional auditory objects with the individual listener's directional acoustic transfer functions that correspond to the relative position of the auditory object with respect to the right and left external ears of the individual listener, optionally adding the signals for the left and right ear of the individual listener representing any of the additional auditory objects to the signals of the left and right ear corresponding to the original sound field;

collecting, arranging, and/or combining the signals intended for the left and right external ear of the individual listener into an output format and identifying these signals as a representation of a three-dimensional auditory scene that enables a perceptually valid acoustic reproduction of the sound that would have been present at the ears of the individual listener, were the individual listener to have been present at the position of the microphone array in the original sound environment.

According to a second aspect of the invention, there is provided a method for transforming the recorded source signal of a source directional acoustic receiver (as defined above, the source directional acoustic receiver is paired with a target directional acoustic receiver) using information derived from the signals recorded simultaneously by a directional microphone array such as described in aspect six (the directional microphone array is positioned in the same sound field as the source directional acoustic receiver and has a fixed geometrical arrangement with respect to the source directional acoustic receiver) so that it would be of such a form that it would be as if the signal had been recorded by the target directional acoustic receiver were the target directional acoustic receiver to have been present in the original sound field and recording simultaneously with the source directional acoustic receiver, the method including the steps of obtaining an estimate of the signals in the low frequency bands of the target directional acoustic receiver, possibly by using a true recording of the low-frequency signals for the target directional acoustic receiver or possibly by deriving the signals in the low frequency bands from a signal recorded simultaneously by another microphone, as could be derived by decomposing the other microphone's recorded signal into separate signals in different frequency sub-bands, possibly using an analysis filter bank as would be used in multirate digital signal processing, and then choosing to keep only the low-frequency signals;

determining, at some point during the process, the directional acoustic transfer functions for a number of directions in space for the source directional acoustic receiver;

determining, at some point during the process, the directional acoustic transfer functions for a number of directions in space for the target directional acoustic receiver;

establishing a relative frame of reference (which may he dynamically changing with time) between the orientation and position of the target directional acoustic receiver and the orientation and position of the source directional acoustic receiver;

possibly allowing for dynamic changes in the relative frame of reference described above;

windowing the microphone signals of the microphone array in the time domain, possibly using overlapping time windows;

determining the average energy in a given frequency band, for a given time window, for the microphone signals in each of the secondary microphones of the directional microphone array (the secondary microphones are defined above and are to be used collectively in describing the incoming direction of the acoustic energy in narrow frequency bands above approximately 1 kHz), possibly by decomposing each microphone signal into separate signals in different frequency sub-bands using an analysis filter bank, as would be used in multirate digital signal processing, and then calculating for each time window the average signal energy level, e(i,j), in each frequency sub-band, i, above approximately 1 kHz, for each secondary microphone, j;

modifying the recorded source signal using information derived from (a) the differences between the directional acoustic transfer functions of the source directional acoustic receiver and the directional acoustic transfer functions of the target directional acoustic receiver, (b) the current relative frame of reference established between the paired source and target directional acoustic receivers and (c) the directional information derived from the recorded microphone signals of the directional microphone array, in order to derive an estimate of the signal that would have been present and recorded by the target directional acoustic receiver, were the target directional acoustic receiver to have been present in the original sound field and recording simultaneously with the source directional acoustic receiver, which may be accomplished by:

(i) possibly deriving gain correction factors, $gc_s(ij)$, for the source directional acoustic receiver (assuming a given relative frame of reference described above) that indicates the difference between the gain of the source directional acoustic receiver and the gain of the target directional acoustic receiver for each frequency band, i, and each direction, j, corresponding to the direction of the secondary microphones in the directional microphone array, these gain correction factors could possibly be derived using the directional acoustic transfer functions of the source and target directional acoustic receivers;

(ii) possibly deriving directionality functions, $h_i$, that takes into account, for a given frequency sub-band, i, and set of secondary microphones, the degree of directionality of the collective set of secondary microphones for acoustic energy in-that frequency sub-band;

(iii) possibly calculating-over all gain correction factors, G(i), for each frequency sub-band using the signal energy levels of the N secondary microphones calculated for the given frequency sub-band and optionally also using the directionality functions, $h_i$, of the secondary microphones for the given frequency sub-band, i, by performing a linear or non-linear weighted average of the gain correction factors across the directions, j, corresponding to the directions of the secondary microphones and the given frequency sub-band, such as would be given, for example, by $$G(i) = h_i\left[e(i,j) - \frac{1}{N}\sum_{j=1}^{N} e(i,j)\right]\frac{e(i,j)}{\frac{1}{N}\sum_{j=1}^{N} e(i,j)}gc_s(i,j);$$

(iv) possibly modifying the amplitude of the signals in the different frequency sub-bands for the source directional acoustic receiver using the over all gain-correction-factors described above;

(v) possibly combining the amplitude modified signals for the different high-frequency sub-bands for the source acoustic receiver with the estimated low-frequency signals, possibly using a synthesis filter bank as would be used in multirate digital signal processing, in order to derive a signal that corresponds to the sound signal for the target directional acoustic receiver that would have been recorded were the target directional acoustic receiver to have been present in the original sound environment and recording simultaneously with the source directional acoustic receiver.

According to a third aspect of the invention, there is provided a method for recording and reproducing a three dimensional auditory scene for individual listeners, the method including the steps of arranging one or more of the microphones in the microphone array, referred to as the primary microphones, to have directional acoustic transfer functions that vary with the direction of the sound source relative to the microphone;

arranging several microphones in the microphone array other than the primary microphones, referred to as the secondary microphones, so that they collectively (with or without the primary microphones) describe the incoming direction of acoustic energy in narrow frequency bands above approximately 1 kHz;

establishing a relative frame of reference (which may be dynamically changing with time) between the orientation and position of the external ears of the individual listener and the orientation and position of the microphone array in the original sound environment at the time of the recording of the sound field;

identifying some of the primary microphones as source directional acoustic receivers and pairing them with the external ears of the individual listener as corresponding target directional acoustic receivers and applying the method of aspect two in order to obtain a perceptually valid estimate of the sound that would have been present at the ears of the individual listener, were the individual listener to have been present at the position of the microphone array and facing a specific direction in the original sound environment.

optionally identifying and filtering any additional auditory objects with the individual listener's directional acoustic transfer functions that correspond to the relative position of the auditory object with respect to the right and left external ears of the individual listener;

optionally adding the signals for the left and right ear of the individual listener representing any of the additional auditory objects to the signals of the left and right ear corresponding to the original sound field.

collecting, arranging, and/or combining the signals intended for the left and right external ear of the individual listener into an output format and identifying these signals as a representation of a three-dimensional auditory scene that enables a perceptually valid acoustic reproduction of the sound that would have been present at the ears of the individual listener, were the individual listener to have been present at the position of the microphone array in the original sound environment According to a fourth aspect of the invention, there is provided a method for recording and reproducing a three dimensional auditory scene for individual listeners, the method including the steps of arranging microphones in a microphone mount such that the microphones together with the microphone mount, referred to as a microphone array, have acoustic properties that vary with the direction of the sound in space;

determining the directional acoustic transfer functions for a number of directions in space for the left and right external ears of the individual listener, establishing a relative frame of reference (which may be dynamically changing with time) between the orientation and position of the external ears of the individual listener and the orientation and position of the microphone array in the original sound environment at the time of the recording of the sound field;

processing the microphones signals by filtering the signals with the directional acoustic transfer functions of the individual listener that correspond to the directions in which the microphones are pointing in space (the directional acoustic transfer functions of the individual listener that correspond to the direction in which a particular microphone is pointing can be derived from the relative frame of reference established between the microphone array and the individual listener's external ears) and then summing these signals to obtain an estimate of the sound that would have been present at the ears of the individual listener, were the individual listener to have been present at the position of the microphone array in the original sound environment.

optionally identifying and filtering any additional auditory objects with the individual listener's directional acoustic transfer functions that correspond to the relative position of the auditory object with respect to the right and left external ears of the individual listener;

optionally adding the signals for the left and right ear of the individual listener representing any of the additional auditory objects to the signals of the left and right ear corresponding to the original sound field.

collecting, arranging, and/or combining the signals intended for the left and right external ear of the individual listener into an output format and identifying these signals as a representation of a three-dimensional auditory scene that enables a perceptually valid acoustic reproduction of the sound that would have been present at the ears of the individual listener, were the individual listener to have been present at the position of the microphone array in the original sound environment According to a fifth aspect of the invention, there is provided a method for recording and reproducing a three dimensional auditory scene for individual listeners, the method including the steps of arranging microphones in a microphone mount such that the microphones together with the microphone mount, referred to as a microphone array, have acoustic properties that vary with the direction of the sound in space;

determining the directional acoustic transfer functions for a number of directions in space for the left and right external ears of the individual listener;

establishing a relative frame of reference (which may be dynamically changing with time) between the orientation and position of the external ears of the individual listener and the orientation and position of the microphone array in the original sound environment at the time of the recording of the sound field;

recording a three dimensional auditory scene using the microphone array, processing the signals recorded by the microphone array using techniques such as blind signal separation or independent component analysis to determine the individual sounds composing the sound field and then applying techniques such as adaptive beamforming or triangulation to determine the direction of the individual sound sources and then filtering the identified individual sound sources with the directional acoustic transfer functions of the individual listener corresponding to the identified direction of the sound sources (the directional acoustic transfer functions of the individual listener's external ears that correspond to a specific direction can be derived from the relative frame of reference established between the microphone array and the individual listener's external ears) to obtain an estimate of the sound that would have been present at the ears of the listener, were the listener to have been present at the position of the microphone array in the original sound environment optionally identifying and filtering any additional auditory objects with the individual listener's directional acoustic transfer functions that correspond to the relative position of the auditory object with respect to the right and left external ears of the individual listener;

optionally adding the signals for the left and right ear of the individual listener representing any of the additional auditory objects to the signals of the left and right ear corresponding to the original sound field.

collecting, arranging, and/or combining the signals intended for the left and right external ear of the individual listener into an output format and identifying these signals as a representation of a three-dimensional auditory scene that enables a perceptually valid acoustic reproduction of the sound that would have been present at the ears of the individual listener, were the individual listener to have been present at the position of the microphone array in the original sound environment.

According to a sixth aspect of the invention, there is provided a method for arranging the microphones of a directional microphone array (e.g., a microphone array with a set of microphones, referred to as secondary microphones, which can be used collectively in describing the incoming direction of the acoustic energy in narrow frequency bands above approximately 1 kHz and up to the high-frequency limit of human hearing, e.g., 16 to 20 kHz) in a microphone mount, the method including the steps of arranging one or more of the microphones in the microphone array, referred to as the primary microphones, to have directional acoustic transfer functions that vary with the direction of the sound source relative to the microphone;

arranging several microphones in the microphone array other than the primary microphones, referred to as the secondary microphones, so that they collectively (with or without the primary microphones) describe the incoming direction of acoustic energy in narrow frequency bands above approximately 1 kHz; the secondary microphones may possibly be microphones such as cardiod microphones, hypercardiod microphones, supercardiod microphones, bi-directional gradient microphones, "shotgun" microphones, omnidirectional microphones;

possibly arranging the microphone mount to be a realistic and life-like acoustic mannequin in which the primary microphones sit in the external ears of the mannequin and the secondary microphones are situated around the head or torso facing various directions in space.

According to a seventh aspect of the invention there is provided a method for deriving individualised numerical correction factors associated with a specific pairing of one directional acoustic receiver, referred to as the source directional acoustic receiver, in an array of microphones with directional acoustic properties (e.g., a microphone array with a set of microphones, referred to as secondary microphones, which can be used collectively in describing the incoming:direction of the acoustic energy in narrow frequency bands above approximately 1 kHz and up to the high-frequency limit of human hearing, e.g., 16 to 20 kHz) to a different directional acoustic receiver (possibly an external ear or possibly another microphone), referred to as the target directional acoustic receiver, the method including the steps of establishing a mathematically defined geometrical arrangement of the target and source directional acoustic receivers;

calculating gain correction factors as the difference between the gain of the source directional acoustic receiver and the target directional acoustic receiver for a set of frequency bands and a set of directions in space using the directional acoustic transfer functions of the source and target directional acoustic receivers;

possibly calculating numerical functions that can account, for a given frequency sub-band and set of collective microphones, for the degree of directionality of the set of collective microphones for acoustic energy in that frequency sub-band;

According to an eighth aspect of the invention there is provided a method for encoding the signals recorded by the microphones of the directional microphone array described in aspect six, the encoding method including the steps of decomposing the secondary microphone signals into separate signals in different frequency sub-bands, possibly using an analysis filter bank as would be used in multirate digital signal processing, optionally decomposing the primary microphone signals into separate signals in-different frequency sub-bands, possibly using an analysis filter bank as would be described in multirate digital signal processing;

windowing the sub-band signals described above in the time domain, possibly using overlapping time windows;

calculating for each time window and each secondary microphone, j, the average signal energy, e(i,j), in each frequency sub-band, i, above approximately 1 kHz;

storing in a compressed format, possibly using perceptual audio coding techniques, or uncompressed format, the signals of the primary microphones;

possibly, when using perceptual audio coding techniques for compressing the primary microphone signals, give extra allowance for the variation in the gain within a population of different individual listeners' directional acoustic transfer functions for a given frequency sub-band and directions in space when calculating the masking levels for frequency sub-bands as is standard in the established art for the perceptual audio coding process;

possibly, when giving extra allowance for the variation in the gain within a population of different individual listeners' directional acoustic transfer functions for a given frequency sub-band, using the average signal energy in the frequency sub-bands of the secondary microphone signals to restrict and determine the region of space in which the variation in the gain within a population of different individual listeners' directional acoustic transfer functions must be considered when calculating the masking levels for frequency sub-bands as is standard in the established art for the perceptual audio coding process;

storing in a compressed or uncompressed format the average signal energy levels, e(i,j), in the different frequency sub-bands for the secondary microphones;

optionally storing in a compressed or uncompressed format the sub-band signals of the secondary microphones for low frequencies below approximately 1 to 5 kHz;

optionally identifying additional auditory objects (possibly fictional or possibly existing in the original sound recording) which can or are to be rendered simultaneously with the original sound field and storing these additional auditory objects along with their relative position and orientation with respect to the recording microphone array collecting, arranging, and/or combining the stored information described above into an encoding format and identifying the collective stored information as the encoded representation of a three-dimensional auditory scene that enables a perceptually valid acoustic reproduction of the sound that would have been present at the ears of the individual listener, were the individual listener to have been present at the position of the microphone array in the original sound environment.

According to a ninth aspect of the invention there is provided a method for decoding and individualising the microphone signals encoded as described in aspect eight, the method including the steps of retrieving, and possibly uncompressing, the primary microphone signals;

retrieving, and possibly uncompressing, the stored values for the average signal energy level corresponding to the time-windowed sub-band signals of the secondary microphones;

optionally retrieving any additional auditory objects and their relative position with respect to the original recording microphone array;

identifying some of the primary microphones as source directional acoustic receivers and pairing these primary microphones with the external ears of the individual listener as corresponding target directional acoustic receivers and applying the method of aspect two in order to obtain an estimate of the sound that would have been present at the ears of the individual listener, were the individual listener to have been present at the position of the microphone array and facing a specific direction in the original sound environment;

optionally filtering the additional auditory objects with the individual listener's directional acoustic transfer functions that correspond to the relative position of the auditory object with respect to the right and left external ears of the individual listener as derived from the stored position of the auditory object with respect to the original directional microphone array, optionally adding the signals for the left and right ear of the individual listener representing any of the additional auditory objects to the signals of the left and right ear corresponding to the original sound field;

collecting, arranging, and/or combining the signals intended for the left and right external ear of the individual listener into a decoded output format and identifying these signals as a decoded representation of a three-dimensional auditory scene that enables a perceptually valid acoustic reproduction of the sound that would have been present at the ears of the individual listener, were the individual listener to have been present at the position of the microphone array in the original sound environment.

According to a tenth aspect of the invention there is provided a method for decoding and individualising the microphone signals encoded as described in aspect eight with the option enabled of storing in a compressed or uncompressed format the sub-band signals of the secondary microphones for frequencies below approximately 1 to 5 kHz, the method including the steps of retrieving, and possibly uncompressing, the primary microphone signals;

retrieving, and possibly uncompressing, the stored values for the average signal energy level corresponding to the time-windowed sub-band signals of the secondary microphones;

retrieving, and possibly uncompressing, the sub-band signals of the secondary microphones for the frequencies below approximately 1 to 5 kHz;

generating new microphone signals corresponding to the secondary microphones by combining the retrieved sub-band signals of the secondary microphones for the frequencies below approximately 1 to 5 kHz with the sub-band signals of some of the primary microphones for frequencies above approximately 1 to 5 kHz that have been modified by applying the method of aspect two in which the source directional acoustic receivers are identified as the primary microphones and the target directional acoustic receivers are identified as the secondary microphones;

filtering the newly derived microphone signals for the secondary microphones with the directional acoustic transfer functions of the individual listener corresponding to the direction of the secondary microphones;

filtering the microphone signals for the primary microphones with the directional acoustic transfer functions of the individual listener corresponding to the direction of the primary microphones;

combining the filtered signals in order to derive signals that correspond to the sound signals for the left and right ears of the individual listener, optionally filtering the additional auditory objects with the-individual listener's directional acoustic transfer functions that correspond to the relative position of the auditory object with respect to the right and left external ears of the individual listener as derived from the stored position of the auditory object with respect to the original recording microphone array;

optionally adding the signals for the left and right ear of the individual listener representing any of the additional auditory objects to the signals of the left and right ear corresponding to the original sound field;

collecting, arranging, and/or combining the signals intended for the left and right external ear of the individual listener into a decoded output format and identifying these signals as a decoded representation of a three-dimensional auditory scene that enables a perceptually valid acoustic reproduction of the sound that would have been present at the ears of the individual listener, were the individual listener to have been present at the position of the microphone array in the original sound environment.

According to an eleventh aspect of the invention there is;provided a method for decoding and individualising the microphone signals encoded as described in aspect eight with the option enabled of storing in a compressed or uncompressed format the sub-band signals of the secondary microphones for frequencies below approximately 1 to 5 kHz, the method including the steps of retrieving, and possibly uncompressing, the primary microphone signals;

retrieving, and possibly uncompressing, the average signal energy values corresponding to the time-windowed sub-band signals, above approximately 1 kHz, of the secondary microphones;

retrieving, and possibly uncompressing, the sub-band signals of the secondary microphones for the frequencies below approximately 1 to 5 kHz;

generating new microphone signals corresponding to the secondary microphones by combining the retrieved sub-band signals of the secondary microphones for the frequencies below approximately 1 to 5 kHz with the sub-band signals of some of the primary microphones for frequencies above approximately 1 to 5 kHz that have been modified by applying the method of aspect two in which the source directional acoustic receivers are identified as the primary microphones and the target directional acoustic receivers are identified as the secondary microphones;

filtering the newly derived microphone signals for the secondary microphones with the directional acoustic transfer functions of the individual listener corresponding to the direction of the secondary microphones;

generating signals corresponding to the signals that would have been present at the external ears of the individual listener, were the individual listener to have been present at the position of the microphone array and facing a specific direction in the original sound environment, by applying the method of aspect two in which the primary microphones are identified as source acoustic receivers and the external ears of the individual listener are identified as target directional acoustic receivers;

combining the signals corresponding to the external ears of the individual listener with the filtered secondary microphone signals in order to derive new and enhanced signals that correspond to the sound signals for the left and right ears of the individual listener;

optionally filtering the additional auditory objects with the individual listener's directional acoustic transfer functions that correspond to the relative position of the auditory object with respect to the right and left external ears of the individual listener as derived from the stored position of the auditory object with respect to the original recording microphone array;

optionally adding the signals for the left and right ear of the individual listener representing any of the additional auditory objects to the signals of the left and right ear corresponding to the original sound field;

collecting, arranging, and/or combining the signals intended for the left and right external ear of the individual listener into a decoded output format and identifying these signals as a decoded representation of a three-dimensional auditory scene that enable a perceptually valid acoustic reproduction of the sound that would have been present at the ears of the individual listener, were the individual listener to have been present at the position of the microphone array in the original sound environment.

According to a twelfth aspect of the invention there is provided a method for transforming the decoded virtual auditory space signals derived, for example, in aspects one, three, nine, ten, and eleven, into a decoded signal suitable for reproducing and enabling a dynamic interaction of the individual listener with the reproduced three-dimensional auditory scene, the method including the steps of establishing an initial and dynamic relative frame of reference between the position and orientation of the individual listener's external ears and the orientation and position of the microphone array in the original sound field during the recording of the sound as described in aspect eighteen below;

monitoring the position and orientation of the individual listener's external ears, possibly using a head-tracking means, during the sound playback and reproduction process for the individual listener, dynamically correcting the playback and reproduction of the sound field such that it maintains a correct spatial relationship with respect to the orientation and position of the listener's external ears during the sound playback and reproduction process, which may possibly be accomplished by:

(i) determining whether the relative position and orientation of the individual listener's external ears have changed (e.g., the individual listener may rotate his/her head or move translationally in the virtual environment in which the sound is being reproduced) with respect to the relative frame of reference that was established initially, (ii) modifying and updating the relative frame of reference between the listener's external ears and the microphone array used to record the original sound field;

(iii) employing, and possibly storing, the modified relative frame of reference described above as is relevant to the application of the method of aspect two in any of the methods of aspects one, three, nine, ten, and eleven in order to obtain a perceptually valid estimate of the sound that would have been present at the ears of the individual listener, were the individual listener to have been present in the original sound environment and positioned and oriented as described by the dynamic frame of reference described above;

(iv) possibly identifying additional auditory objects in the decoded signal that are to be rendered simultaneously with the original sound field and tracking the relative position and orientation of these additional auditory objects with respect to the individual listener's external ears;

(v) possibly filtering the additional auditory objects with the correct directional acoustic transfer functions of the external ears of the individual listener corresponding to the relative position of the listener's external ears with respect to the additional auditory objects;

(vi) possibly adding the signals for the left and right ear of the individual listener representing any of the additional auditory objects to the signals of the left and right ear corresponding to the original sound field;

(vii) collecting, arranging, and/or combining the signals intended for the left and right external ear of the individual listener into a decoded output format and identifying these signals as a dynamically decoded output signal representation of a three-dimensional auditory scene that enables a perceptually valid acoustic reproduction of the sound that would have been present at the ears of the individual listener, were the individual listener to have been present in the original sound environment at described dynamically by the relative frame of reference described above.

According to a thirteenth aspect of the invention there is provided a method to encode existing sound material or any newly generated sounds (generated naturally or artificially) into a format that is consistent with the encoding of sound signals described in aspect eight, the method including the steps of possibly identifying (if using existing sound material) individual auditory objects in the original sound material, possibly by actually obtaining the individual auditory objects from the original sound material, or possibly by processing the original sound material using techniques such as blind signal separation or independent component analysis to determine individual auditory objects composing the sound field;

possibly identifying newly generated sounds as individual auditory objects;

positioning the individual auditory objects in a virtual space relative to a virtual directional microphone array in that virtual space (the virtual directional microphone array is one such as described in aspect six);

determining, at some point during the process, the directional acoustic transfer functions of the microphones in the virtual directional microphone array described above for some directions in the virtual space;

filtering, possibly electronically or possibly computationally, the signal representing each individual auditory object with the directional acoustic transfer functions of the microphones in the virtual directional microphone array in order to determine the signals that would have been recorded by the microphones in the virtual directional microphone array given the relative position of the virtual directional microphone array with respect to the individual auditory objects in the virtual space;

combining additively for each microphone in the virtual directional microphone array the signals representing each of the individual auditory objects that have been filtered with the microphone's directional acoustic transfer functions as described above in order to obtain a single signal representing the complete sound field as recorded by the given microphone of the virtual directional microphone array;

using the synthesized signals for the microphones in the virtual directional microphone array as described in aspect eight in order to obtain an encoded representation of a three-dimensional auditory scene that is consistent with the encoding described in aspect eight and that enables a perceptually valid acoustic reproduction of the sound that would have been present at the ears of the individual listener, were the individual listener to have been present at the position of the virtual directional microphone array in the virtual sound environment.

According to a fourteenth aspect of the invention, there is provided a method for conservatively estimating masking levels when using perceptual audio coding techniques for directional microphone arrays and/or 3D audio, the method including the steps of determining the average population variance in the gain of the directional acoustic transfer functions for individual listeners for a given frequency sub-band and a given direction in space;

optionally using some of the microphone signals of the directional microphone array to estimate and restrict which regions of space must be considered when allowing for variations in the gain of the directional acoustic transfer functions for individual listeners for a given frequency sub-band when calculating the masking levels corresponding to a given frequency sub-band;

incorporating the variations in the gain of the directional acoustic transfer functions for individual listeners for a given frequency sub-band and directions in space so that the masking levels corresponding to a given frequency sub-band are more conservatively estimated when calculating masking levels as is standard in the established art of perceptual audio coding;

applying the more conservative estimations of masking levels into a perceptual audio coding technique;

According to a fifteenth aspect of the invention, there is provided a method for attaching and detaching physical structures to the microphone arrays described in aspects one through thirteen, that improve the directional acoustic properties of the microphones in the microphone array, possibly in such a manner that the directional acoustic properties of some of the microphones are more similar to that for an individual listener's external ears.

According to a sixteenth aspect of the invention, there is provided a method for applying the method of aspect fourteen to the encoding of microphone signals of a microphone array described in any of the aspects one through thirteen in order to make a more conservative estimation of masking levels as is standard when applying the established art of perceptual audio coding techniques to audio signals.

According to a seventeenth aspect of the invention, there is provided a method for modifying the recording conditions of the microphones in the microphone arrays described in any of the aspects one through thirteen, preferably in real-time, in order to improve the recording conditions, the method including such possibilities as filtering the microphone signals with low-pass, high-pass, band-pass, or band-stop filters;

amplifying or attenuating the microphone signals;

balancing the microphones with respect to each other so that the recording conditions are equivalent for all of the microphones;

removing unwanted noise/sounds from the microphone signals.

According to an eighteenth aspect of the invention, there is provided a method for establishing a relative frame of reference (which may be dynamically changing with time) between the orientation and position of the external ears of the individual listener and the orientation and position of the microphone array, in any of the microphone arrays described in the previous aspects one through thirteen, in the original sound environment at the time of the recording of the sound field, possibly in such a manner that the external ears of the listener may be identified with the primary microphones in the microphone array.

According to a nineteenth aspect of the invention, there is provided a method for storing the recorded microphone signals of any of the microphone arrays described in any of the previous aspects one through thirteen;

According to an twentieth aspect of the invention there is provided a method for post-processing and modifying the estimated sound signals that would have been present at the ears of the individual listener described in any of the previous aspects one through thirteen, the method including overlaying and adding speech, music and other sounds, removing noise, adding sound effects, amplification and attenuation of specific frequency bands.

According to a twenty-first aspect of the invention there is provided a method for transforming the output signals representing a three-dimensional auditory scene for an individual listener as described in aspects one, three, four, five, nine, ten, eleven, twelve, and thirteen into any standard audio output format such as, but not limited to, Dolby Digital 5. 1, Dolby AC-3, Dolby SR-D (spectral recording digital), Digital Theatre Systems (DTS), the IMAX 6.1 output format, the Sony Dynamic Digital Sound 7.1 output format, Dolby stereo (4-2A), stereo.

According to a twenty-second aspect of the invention there is provided a method for applying the encoding and decoding of a three-dimensional auditory scene for an individual listener as described in aspects one, three, four, five, nine, ten, eleven, twelve, and thirteen over the internet, using, for example, the world wide web as an interface for the encoding and decoding process.

According to a twenty-third aspect of the invention there is provided a method for identifying and using several subgroups of microphones (the subgroups may be overlapping) in the directional microphone array described in aspect six, so that each subgroup of microphones acts as a directional acoustic receiving array, such as the Lehr-Widrow array, in order to-improve upon or replace the microphone signals for some or all of the secondary microphones in aspect two and aspect eight and for some or all of the microphone signals in aspect four, were the directional microphone array described in aspect six to be used as described in aspects two, eight, and four, the method including the steps of identifying for each microphone, whose signal is to be improved upon or replaced, a subset of microphones in the directional microphone array which are to be used as a directional acoustic receiving array such as the Lehr-Widrow array described in the U.S. Pat. No. 5,793,875;

possibly processing the signals for each subset of microphones identified as the directional acoustic receiving array, as described above, using the weighted summation and band-pass filtering method described in the U.S. Pat. No. 5,793,875 or any other adaptive or nonadaptive beam-forming method in order to obtain a directional acoustic signal that can replace or improve upon the original microphone signal of the microphone which is identified as corresponding to the subset of microphones identified as a directional acoustic receiving array;

possibly processing the signals for each set of microphones identified as the directional acoustic receiving array, as described above, using the weighted summation and band-pass filtering method described in the U.S. Pat. No. 5,793,875 or any other adaptive or nonadaptive beam-forming method in order to directly determine the average signal energy level, e(i,j), in the ith frequency sub-band for the direction in space corresponding to the jth secondary microphone as described in aspects two or eight.

According to a twenty-fourth aspect of the invention there is provided equipment for recording and reproducing a three dimensional auditory scene for individual listeners, the equipment including An acoustic sensing means for recording the sound field;

a supporting means for mounting, holding, stabilising, and moving the one or more array of microphones;

an attaching means for mounting video recording equipment, range finding, and other equipment;

an attaching means for mounting physical and directional acoustic filtering structures for both the primary and secondary microphones;

a communication means for sending and receiving command or data signals;

a data collection means for recording, storing and encoding (as in aspect eight) the signals recorded from the microphones;

a monitoring means for listening to the recorded sound either in real-time or not in real-time;

an equipment interface means for altering the recording of the sound field across the array of microphones such as low-pass, high-pass, band-pass, or band-stop filtering the microphone signals, amplifying or attenuating the microphone signals, removing unwanted noise/sounds from the microphone signals;

a processing means for decoding (as in aspects nine to eleven) the encoded microphone signals and determining the estimate of the sound that would have been present at the ears of the listener, were the listener to have been present at the position of the microphone array in the original sound environment and possibly post-processing the estimated sound signals, for example, by overlaying speech/other sounds, adding sound effects, modifying the gains/attenuation in a given frequency band

BRIEF DESCRIPTION OF THE DRAWING

Embodiments of the invention are now described by way of example with reference to the drawings in which.

DETAILED DESCRIPTION OF THE DRAWING

Figure 1:
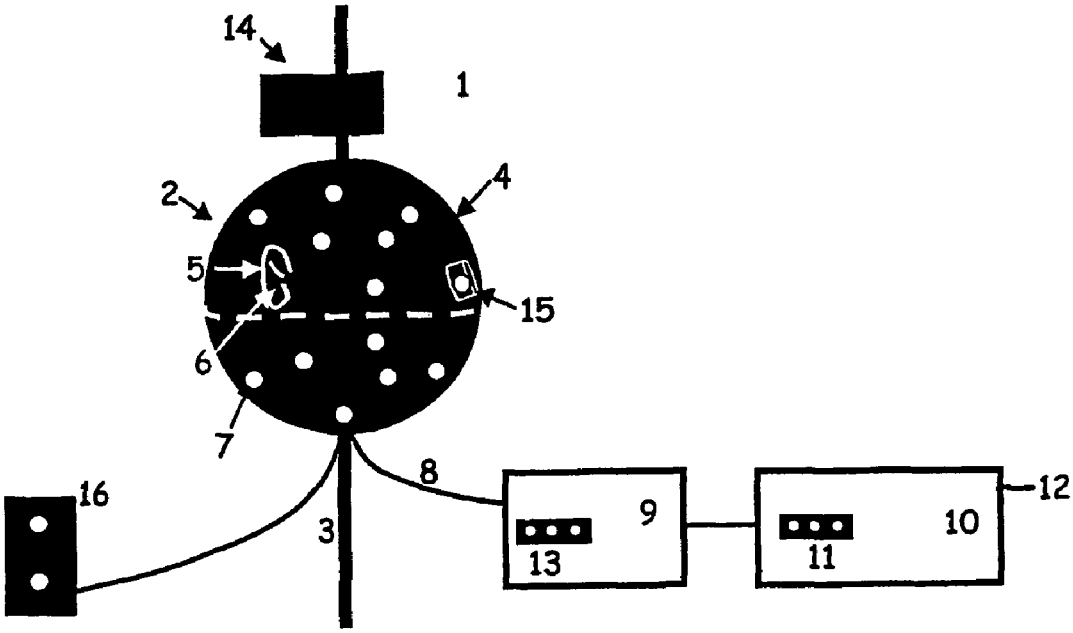
FIG. 1 shows, schematically, an embodiment of equipment for recording and reproducing a three dimensional auditory scene for individual listeners.

In the drawing, reference numeral (1) generally designates equipment, in accordance with the invention, for recording and reproducing a three dimensional auditory scene for individual listeners. The equipment includes a recording means and one or more microphone arrays (2) and (16), also in accordance with the invention, a supporting means (3) for holding, moving the microphone array and also for attaching other devices (14) such as-video recording and range finding equipment, a data storage and compression means (9), and a processing means (10) which can be connected to the data storage means to process the recorded signals from the microphone array.

The microphone array (2) is used for recording the sound field of a three dimensional auditory scene which is assumed, but not depicted in the drawing. The individual microphones preferably have strong directional characteristics, but may be, for example, microphones with hyper-cardiod, cardiod, figure-of-eight, and omni-directional directional characteristics. The microphone array (2) comprises a microphone support mount (4) for holding the individual microphones. The support mount may be composed of physically separate entities at different physical locations. The microphone support mount (4) also supports one or more directional acoustic filtering structures (5) for the one or more primary recording microphones (6). The directional acoustic filtering structures (5) will acoustically attenuate or amplify the sound frequencies recorded in the primary microphones (6) differently depending on the direction of the sound source relative to the primary microphones (6). The directional acoustic filtering structures (5) may be attachable and detachable and may be chosen to match the acoustic filtering characteristics of the external ears of the recording engineer operating the equipment and monitoring the microphone signals. Several secondary microphones (i) are embedded in the microphone support mount (4). Additional acoustic filtering structures (15) may be used for the secondary microphones and may be attachable or detachable. The physical structure of the microphone support mount will provide directional acoustic filtering for the secondary and primary microphones.

The microphones in the microphone array (2) can be matched with directions in space. That is to say, the microphones point in a particular direction in space so that the gain of the signal is greatest for that specific direction in space. This particular direction in space can be associated with the given microphone. Furthermore, the primary microphones (6) may be matched with the external ears of the individual listener so that a relative frame of reference may be established between the orientation of the listener's external ears and the microphone array. Optionally, the primary microphones do not have to be paired with the external ears of the listener. In this case, a relative frame of reference can still be arbitrarily established between the orientation of the listener's external ears and the microphone array.

The microphone array (2), as described above, can be, for example, electrically connected via a lead (8) or via a wireless connection to a data storage, compression, and encoding means (9) that stores the signals recorded by the microphone array (2). The recording conditions for the microphone array can be altered using the control interface (13). This control interface would allow, for example, the recording conditions for the recording of the sound field across the array of microphones to be altered by low-pass, high-pass, band-pass, or band-stop filtering the microphone signals, amplifying or attenuating the microphone signals, removing unwanted noise/sounds from the microphone signals.

A processing and decoding means (10) can be connected to the data storage, compression, and encoding means (9) and modifies the microphone signals stored in the data storage and compression means (9) using both the directional acoustic transfer functions of the microphone array and the directional acoustic transfer functions of the individual listener. The directional acoustic transfer functions for the microphone array and for the individual listener can be downloaded and stored to the processing means (10) using any of a number of existing communication interfaces (11) such as serial or parallel ports, a smart card, wireless communication, and other similar means of communication. The processing means (10) produces output audio signals (12) for playback over headphones or over loudspeakers that reproduce a three dimensional auditory scene for individual listeners or that reproduce a three dimensional auditory scene for individual listeners with some modifications such overlaying speech or other sound onto the recorded auditory scene and also, for example, removing sounds and producing sound effects.

Figure 2:
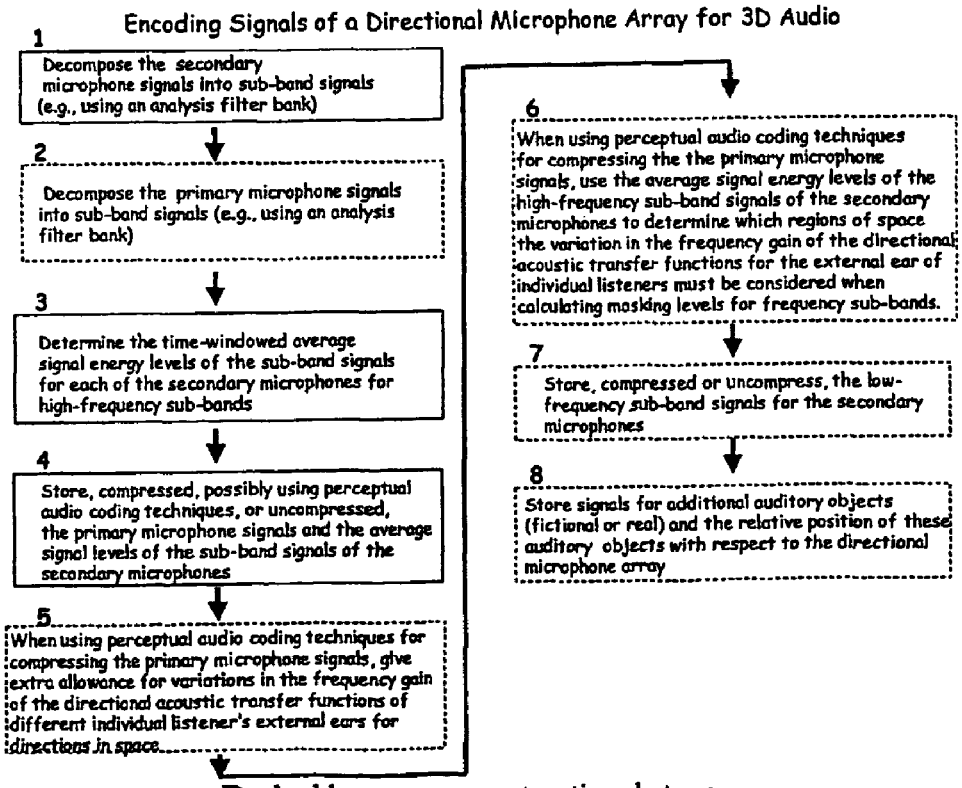
FIGS. 2 to 7 show flow charts of various steps in embodiments of a method of recording and reproducing a three dimensional auditory scene for individual listeners.
Figure 3:
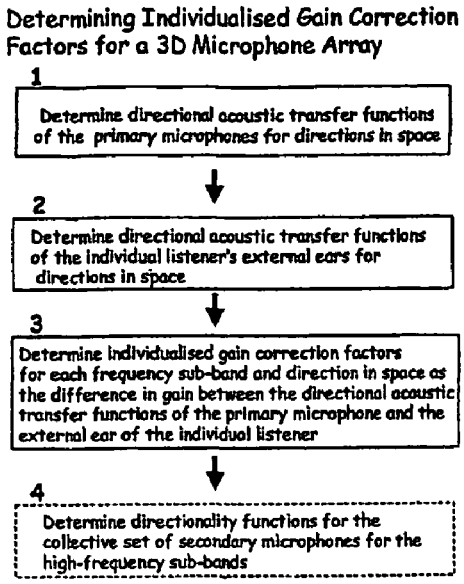

The method of encoding signals using the encoding means (9), is described with reference to FIG. 2. In Step 1, the secondary microphone signals are decomposed into sub-band signals in different frequency bands using, for instance, an analysis filter bank. Optionally, in Step 2, the primary microphone signals can also be decomposed into sub-band signals in different frequency bands. In Step 3, the secondary microphone signals are windowed in the time-domain. In Step 4, the average signal energy level in each frequency sub-band for each secondary microphone is calculated. In Step 5, the primary microphone signals and average signal energy levels for the-frequency sub-bands of the secondary microphone signals are stored in either a compressed or uncompressed format. The primary microphone signals may be compressed using perceptual audio coding techniques. In Step 5, when using perceptual audio coding techniques, extra allowance may be given when calculating masking levels for a given frequency sub-band to take into account the population variance in the gain of directional acoustic transfer functions for human external ears for directions in space. In addition, in Step 6, the average signal energy level in the frequency sub-band signals for the secondary microphones may be used to determine which direction or regions of space are to be employed when determining the population variance in the gain of the directional acoustic transfer functions for the given frequency sub-band in which masking levels are being calculated. In Step 7, the low-frequency sub-band signals, e.g., for frequencies below 1 to 5 kHz, of the secondary microphone signals may be stored in either a compressed or uncompressed format. In Step 8, the sound signals for any additional auditory objects may be stored in either a compressed or uncompressed format. Also the position of the additional auditory objects relative to the microphone array is also stored in either a compressed or uncompressed format The method of determining correction factors that enable the individualising of the signals of a microphone array for individual listeners, such as is described in aspects nine to eleven, is described with reference to FIG. 3. In Step 1, the directional acoustic transfer functions of microphones in the microphone array, such as described in aspect six, are determined. In addition, in the process of producing individualised signals for the individual listener, it is required that the directional acoustic transfer functions of the individual listener be determined for some directions in space as described in Step 2. In Step 3, differences between the gain in a given frequency sub-band for the directional acoustic transfer functions of the primary microphones and the directional acoustic transfer functions of the individual listener for given directions in space are determined. These differences can be taken as gain correction factors with which to adjust the signal levels of the frequency sub-band signals of the primary microphones so that they better match the gain characteristics of the individual listeners directional acoustic transfer functions. In addition, in Step 4, numerical functions can be calculated that account for the variations in the degree of directionality of the secondary microphones for different frequency sub-bands.

Figure 4:
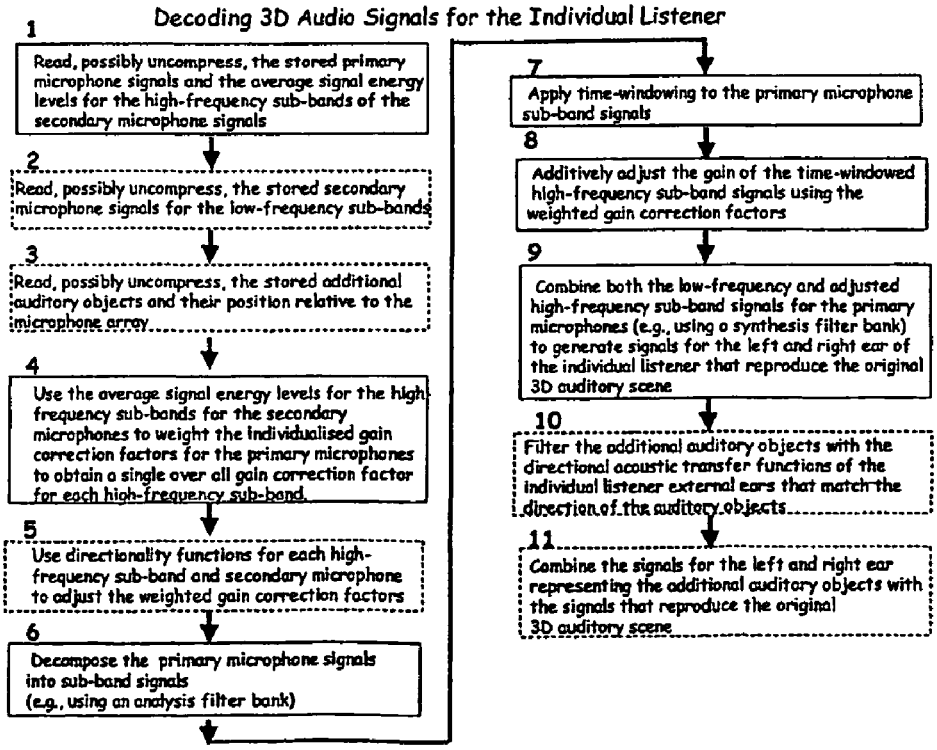

The method of decoding microphone signals recorded from a directional microphone array, such as described in aspect six, during a three-dimensional auditory scene is described with reference to FIG. 4. In Step 1, the stored primary microphone signals and the average signal energy levels for the high-frequency sub-bands for the secondary microphones are retrieved and possibly uncompressed. In Step 2, the low-frequency sub-band signals for the secondary microphones are optionally retrieved and possibly uncompressed. In Step 3, any additional auditory objects and their position relative to the microphone array can be retrieved and possibly uncompressed. Step 4 -begins the process of individualising the microphones signals. Specifically, the average signal energy levels in the high-frequency sub-bands for the secondary microphones is calculated. As each secondary microphone corresponds to a direction in space, a collective estimate of the signal energy levels across all of the secondary microphones will give some indication of the incoming direction of energy in a given high-frequency sub-band. Thus the average signal energy level in a given frequency sub-band across the secondary microphones can be used to weight the gain corrections factors for a particular pairing of a primary microphone with an external ear of the individual listener. That is to say, if the signal of a primary microphone is compared or likened to the hypothetical signal in an external ear of the individual listener, then the directional acoustic transfer functions of the primary microphone, as compared with the directional acoustic transfer functions of the individual listener's external ear, will determine gain correction factors for a given frequency sub-band and direction in space corresponding to the direction of a secondary microphone. Such gain correction factors for a given frequency sub-band may be computed for each direction corresponding to a secondary microphone. A weighted linear or non-linear average of these gain correction factors for a given frequency sub-band may be calculated using the average signal energy levels of the secondary microphones as weighting factors. Step 4 captures the process of calculating a weighted average of the individualised gain correction factors for a given frequency sub-band. In Step 5, the degree of directionality of the secondary microphones may be taken into account when calculating the over all gain correction factors for a given high-frequency sub-band. This is accomplished by calculating and using directionality functions that enable the adjustment of the values obtained for the over all gain correction factors. In Step 6, the primary microphone signals can be decomposed into sub-band signals using, for instance, an analysis filter bank as is common in multirate digital signal processing. In Step 7, the sub-band signals of the primary microphones can be time-windowed. In Step 8, for each time-window, the gain of the high-frequency sub-band signals can be adjusted using the gain correction factors calculated in Step 4. In Step 9, the low-frequency sub-band signals for the primary microphones can be combined with the gain-adjusted signals for the high-frequency sub-bands using, for example, a synthesis filter bank as is common in multirate digital signal processing, to derive individualised signals for the left and right ears of the individual listener corresponding to a perceptually valid reproduction of the original sound field. In Step 10, any additional auditory objects can optionally be filtered with the directional acoustic transfer functions of the individual listener's external ears corresponding to the relative position of the additional auditory objects with respect to the external ears of the listener. In Step 11, the signals for the left and right ear of the listener representing the additional auditory objects can be combined with the signals representing the original 3D auditory scene to generate the final desired three-dimensional sound reproduction.

Figure 5:
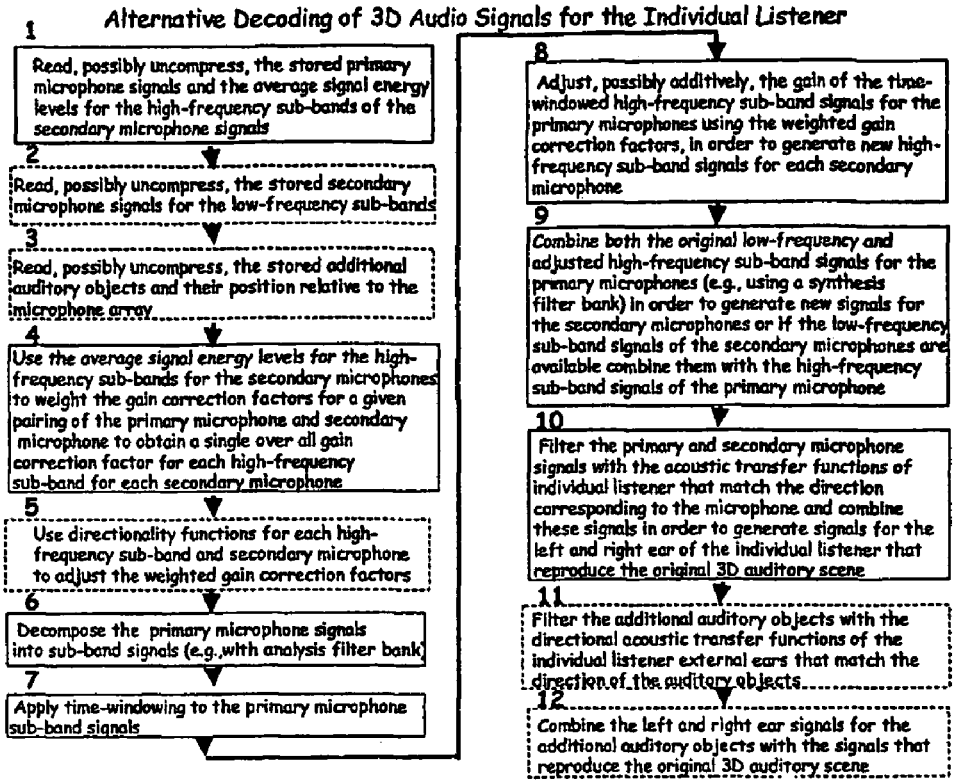

An alternative method for decoding microphone signals recorded from a directional microphone array, such as described in aspect six, used to record a three-dimensional auditory scene is described with reference to FIG. 5. In this alternative method, the Steps 1-5 are basically the same as described above for FIG. 4. An essential idea behind the method shown in FIG. 5 is that the secondary microphone signals may be recovered from the primary microphone signals. In other words, the primary microphone signals can be adjusted so as to make an estimate of the secondary microphone signals. Thus Steps 1-5 derive gain correction factors with which to modify the high-frequency sub-band signals of the primary microphones in order to obtain an estimate of the signals in the secondary microphones. In Step 6, the primary microphone signals are decomposed into sub-band signals, possibly using an analysis filter bank. In Step 7, the sub-band signals of the primary microphones are windowed in the time-domain. In Step 8, the primary microphone signals are adapted to match a given secondary microphone. That is to say, the over all gain correction factors corresponding to a given pairing of a primary microphone with a secondary microphone, are used to modify the gain of the high-frequency sub-band signals of the primary microphone. In Step 9, the low-frequency sub-band signals of either the secondary microphone (if available) or the primary microphone (if the low-frequency sub-band signals of the secondary microphones are not available) are combined with the modified high-frequency sub-band signals of the primary microphones in order to obtain an estimate of the sound present at the secondary microphone. In Step 10, the primary microphone signals and the re-generated secondary microphone signals are filtered with the individual listener's directional acoustic transfer functions that correspond with the direction of the microphones in the array. The signals for all of the microphones for a given ear are then additively combined to produce a single signal representing the signal for that ear for the individual listener that produces a perceptually valid reproduction of the original three-dimensional auditory scene. In Step 11, any additional auditory objects can optionally be filtered with the directional acoustic transfer functions of the individual listener's external ears corresponding to the relative position of the additional auditory objects with respect to the external ears of the listener. In Step 12, the signals for the left and right ear of the listener representing the additional auditory objects can be combined with the signals representing the original three-dimensional auditory scene to generate the final desired three-dimensional sound reproduction.

Figure 6:
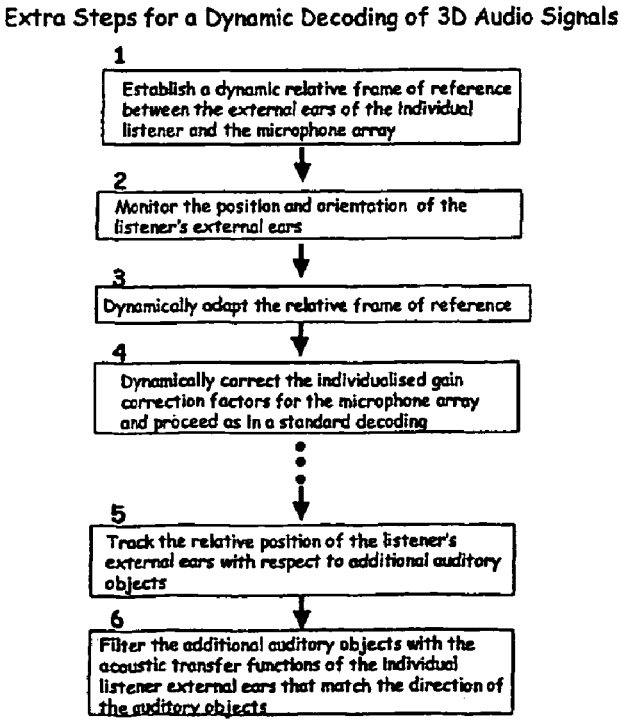

The decoding methods described above are easily adapted to a more dynamic sound reproduction process in which the position and movement of the individual listener are tracked and taken into account accordingly. The extra steps involved in such a dynamic decoding are described with reference to FIG. 6. In Step 1, a dynamic relative frame of reference is established between the position and orientation of the individual listener's external ears with respect to the original position and orientation of the directional microphone array in the original sound field. In Step 2, a tracking means such as an electromagnetic head-tracking system are used to track the orientation and position of the listener's external ears. As the listener moves about in the virtual sound environment, the relative position of the listener relative to the original position and orientation of the directional microphone array used to record the original sound environment is tracked and monitored. In Step 3, the relative position and orientation of the listener's external ears relative to the directional microphone array is continuously adapted and used to establish a frame of reference indicating the geometrical relationship between the position of the individual listener's external ears and the position of the microphone array in the original sound environment. In Step 4, the individualised gain correction factors for the microphone array are calculated based on the current position and orientation of the listener's external ears as described by the current relative frame of reference. After Step 4, the standard steps used to decode the microphone signals are followed. In Step 5, the position and orientation of the listener's external ears relative to any additional auditory objects is tracked. In Step 6, the additional auditory objects are filtered with the directional acoustic transfer functions of the individual listener that correspond to the current relative position of the listener's external ears relative to the additional auditory objects. The directional signals corresponding to the additional auditory objects can be combined with the directional signals corresponding to the original three-dimensional auditory scene in order to render the desired final three-dimensional sound.

Figure 7:
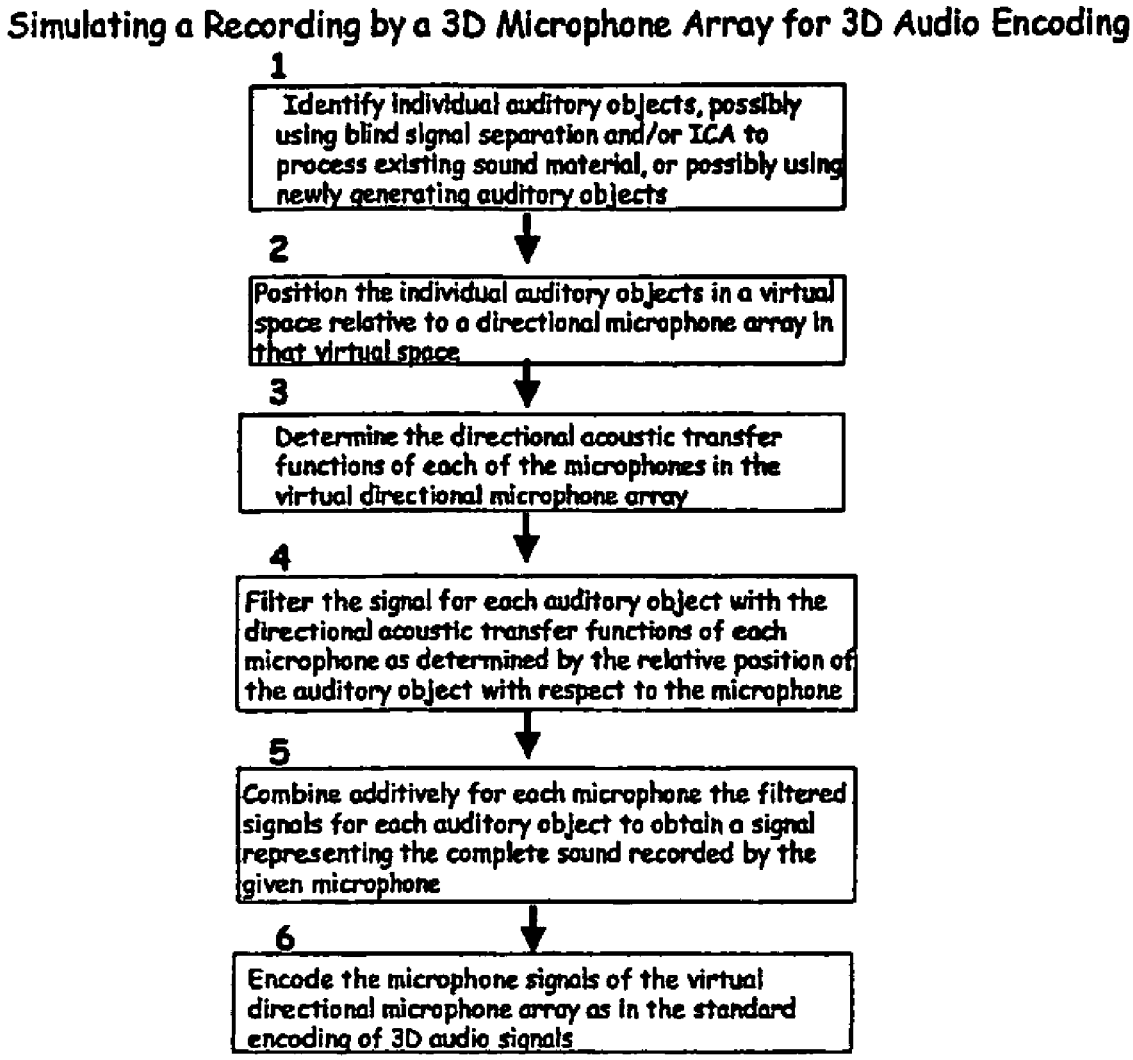

The recording of a three-dimensional auditory scene by a directional microphone array can be simulated and then encoded as a real three-dimensional auditory scene. That is to say, an artificially simulated recording of a three-dimensional auditory scene can be used to computationally encode previously existing sound material and newly generated sounds into a perceptually valid three-dimensional sound reproduction process. The method for simulating the recording of a three-dimensional auditory scene is described with reference to FIG. 7. In Step 1, individual auditory objects are identified. If previously existing sound material is being used, then methods of signal separation such as blind signal separation and independent component analysis can be used to process the existing sound in order to identify individual auditory objects. If new sounds are being generated, these sounds themselves can be the individual auditory objects. In Step 2, the individual auditory objects are positioned in a virtual sound environment relative to a directional microphone array ;in that virtual sound environment. In Step 3, the directional acoustic transfer functions of the microphones in the virtual directional microphone array are determined for the given virtual sound environment In Step 4, the signal for each auditory object is filtered with the directional acoustic transfer functions for each microphone that corresponds to the relative position of the auditory object with respect to the microphone. For each microphone in the virtual directional microphone array, the signals of all of the auditory objects that have been filtered with the directional acoustic transfer functions of the microphone (i.e., the directional acoustic transfer functions corresponding to the relative position of the auditory objects with respect to the microphone) are additively combined to obtain a single signal representing the complete sound that would be recorded by that microphone were it in a real sound field. The simulated recorded signals of the microphones in the microphone array can then be encoded as in the standard encoding of the signals of a directional microphone array as described in aspect eight.

A more general overview is given of the invention and its application to the recording of a three-dimensional auditory scene. There is a difficulty in recording a three dimensional auditory scene that has no parallel in three-dimensional visual displays. This difficulty is related to the fact that the three dimensional auditory scene has to be rendered differently for each individual listener. That is to say, the morphology of an individual's external auditory periphery (including outer ear shape and concha shape) is "individualised" or unique in the same sense that thumb printmarks are individualised. Associated with the individualised morphology, every individual has different peripheral auditory acoustic filtering characteristics or directional acoustic transfer functions referred to as head-related transfer functions (HRTFs). Without measuring the listener's HRTFs, the only option left for recording and reproducing a three dimensional auditory scene for individual listeners is that the original sound field be exactly reproduced and that the listener be positioned correctly in that sound field. This, however, would require either recreating the entire auditory scene in its original location with the original sound sources, or measuring the sound pressure level on a closed surface surrounding the imaginary position of the listener's head with an inter-microphone spacing on the order of a centimetre, which would effectively block or diffract the original sound field and require an inordinately large number of microphones. Therefore a perfect reproduction of the sound field at all locations is not feasible.

Given the discussion above, three primary requirements are described that have to be met in order to record and reproduce a three dimensional auditory scene for the individual listener. (1) the HRTFs of the listener have to be measured or estimated computationally; (2) the directional acoustic transfer functions of the microphone array have to be measured; (3) sufficient directional acoustic information has to be recorded during the acoustic recording of a three dimensional auditory scene such that the recording can be modified using the directional acoustic transfer functions of both the listener and the directional microphone array such that the sound is perceptually correct to the individual listener. Previous recordings of a three dimensional auditory scene have not attempted to record sufficient acoustic directional information in order to modify the recording for the individual listener, nor developed a method such that this modification is possible. That is to say, current methods for recording a three dimensional auditory scene generally use one or more microphones to record the sound field. Loudspeakers are then arranged in a room and the recorded signals or some linear combination of the recorded signals is played over the loudspeakers. The assumption behind this method is that if the listener is positioned at the appropriate location in the room, then the listener's ears will filter the sound field appropriately. To date, no such methods or equipment have been developed for improving the recording of a three dimensional auditory scene so that it is appropriate for the individual listener and results in a more accurate reproduction of the sound that the listener would have heard were the listener to have been present in the original sound field. Generally, an individualised three dimensional auditory scene has to be computationally rendered or simulated using the listener's HRTFs-not recorded acoustically.

A brief discussion follows of how the method and equipment described in this application allow the recording of a three dimensional auditory scene-to be reproduced for the individual listener. First of all, some of the recording microphones (6) must have directional acoustic properties. The acoustic directionality of a given microphone results from two factors: (i) the microphone itself may have directional characteristics such as a hypercardiod gain pattern; (ii) the physical structures nearby and around the microphone will diffract and refract acoustic waves resulting in acoustic directionality. The acoustic directionality of a microphone in the microphone mount can be determined by measuring the acoustic impulse response of the microphone for each direction in space. The frequency response of the microphone for each direction in space can be determined by taking the Fourier Transform of the microphone's impulse response for each direction in space. The directionality of the primary microphones may or may not be chosen to be similar to that for the human external ears.

In accordance with the discussion above, a physical structure with directional acoustic filtering properties (5) is positioned and shaped properly so that it acoustically filters the sound arriving at the primary recording microphones (6), possibly in a manner similar to that for the human external ears. The directional acoustic transfer functions for the primary microphones (6) is generally measured for all directions in space or at least for a dense and discrete subset of all directions in space. The directional acoustic transfer functions of the individual listener's external ears is also generally determined for all directions in space or at least for a dense and discrete subset of all directions in space. The difference between the directional acoustic transfer functions of the primary microphones and the directional acoustic transfer functions of the listener must then be corrected when reproducing the sound in order to achieve a perceptually correct and individualised reproduction of a three dimensional auditory scene.

Human auditory and psychoacoustic research has shown that for humans the perceptually salient directional information in an acoustic signal occurs for those frequencies above 3 or 4 kHz and that perceptually salient temporal information in an acoustic:signal occurs in the phase and envelope of the signal for frequencies below 5 kHz and only in the temporal envelope of the signal for frequencies above 5 kHz. Therefore, a perceptually correct reproduction of a three dimensional auditory scene requires that the phase and envelope of the signal in the low frequencies be correct and-that both the directional information in the acoustic signal for those frequencies above 3 or 4 kHz be correct, as well as the temporal envelope of the signal for these frequencies. Thus the pattern of gain and attenuation for those frequencies above 3 or 4 kHz must be modified differently for each individual listener.

A brief description of signal processing methods that may be used to achieve perceptually correct acoustic signals for the individualised reproduction of a three dimensional auditory scene using the equipment and methods described above is given. As there are several approaches to the signal processing methods with differing advantages, each method is described in turn, generally in an order of increasing computational requirements, but not necessarily in the order of effectiveness. All of the methods assume that the microphone mount that supports the secondary microphones, together with the intrinsic directionality of the gain pattern for the secondary microphones; must-have sufficient directional acoustic properties such that the direction or directions of the incoming signals in a given frequency sub-band can be estimated. In addition, all of the signal processing methods that are described here assume that a fixed directional frame of reference can be established for the individual listener's external ears with respect to the microphone array. In other words, if the individual listener were positioned in the original sound field at the location of the microphone array and oriented in a particular direction (i.e., his/her nose would be pointing in a specific direction in space relative to the microphones in the microphone array), then a fixed directional frame of reference establishes the geometrical relationship between the listener's external ears and the individual microphones in the microphone array. By establishing such a frame of reference, the directional acoustic transfer functions of the individual listener's external ears can be compared in a meaningful way with the directional acoustic transfer functions of the microphones in the microphone array. Furthermore, the primary microphones may or may not be arranged such that the position of the primary microphones in the microphone array matches the position of the listener's external ears, were the listener to be positioned at the location of the microphone array and facing a specific direction in space. In summary, by establishing a relative frame of reference of the listener's external ears relative to the microphone array, the directional acoustic transfer functions of the microphones in the microphone array can be analysed relative to the directional acoustic transfer functions of the individual listener, and vice versa, the directional acoustic transfer functions of the individual listener can be analysed relative to the directional acoustic transfer functions of the microphones in the microphone array.

A first signal processing method involves approximating the sound originating from a given direction in space as the signal recorded by the microphone in the microphone array pointing in that direction in space. For example, the signal recorded by a microphone in the microphone array pointing straight ahead would represent the sound coming from a direction straight ahead. This is not a perfect approximation because the microphone pointing straight ahead will also record sound originating from directions other than straight ahead. Nonetheless, each recorded microphone signal is in this way paired with a direction in space and can be filtered with the directional acoustic transfer functions of the individual listener for that direction in space. These signals can then be summed in order to obtain an estimate of the sound that would have been present at the ears of the individual listener, were the individual listener to have been present at the position of the microphone array in the original sound environment. The individualized acoustic signals can then be played over earphones in virtual auditory space or over an array of loudspeakers in the free-field using appropriate methods of inverse filtering for cross-talk cancellation of the loudspeakers.

A second signal processing method involves the application of sub-band filtering of the microphone signals similar to that which occurs in MPEG audio encoding. A Time Domain Aliasing Cancellation Filter Bank (TDAC), also referred to as the Modulated Lapped Transform (MLT), can be used, for example, to divide the original time waveforms into several different time waveforms representing the signals in the different frequency sub-bands. This is referred to as the analysis filtering stage. For the high frequency sub-bands related to directional hearing, the secondary microphones are used to estimate the directions from which the energy in the high frequency sub-bands is originating. This will allow for energy correction factors to be applied to the signals in the high frequency sub-bands of the signals recorded from the two primary microphones. The energy correction factors are derived from the difference between the directional acoustic transfer functions of the primary microphones mounted in the microphone mount and the directional acoustic transfer functions for the individual listener's external ears.

For the continuing description, it is assumed that the directional acoustic transfer functions for both the primary microphones (6) in the microphone mount and the external ears of the individual listener have been determined in some way and are known. Furthermore, the time signals recorded by the microphones are windowed in the time domain. For each time window an analysis is made of the energy in each of the frequency sub-bands. For a given frequency and direction in space there will be a gain adjustment factor of the order of several dB because the acoustic filtering properties of the microphone mount for the one or more primary microphones will differ from that for the individual listener's two ears. The array of secondary microphones (7) may, for example, be arranged and mounted as a spherical array so that the sound level recorded for a given frequency sub-band will indicate which direction or directions the energy in a given frequency sub-band is primarily coming from, i.e., it will provide direction of arrival information for acoustic energy in a given frequency sub-band. Of course, the microphone array in not perfectly directional and each microphone in the microphone array will demonstrate some energy for the given frequency sub-band. Therefore, the overall gain correction factor for a given frequency sub-band can be derived, for example, from a weighted combination of the gain correction factors for each microphone in the microphone array and also a directionality function which accounts for the degree of directionality of the microphone array for the given frequency sub-band (the directionality of the microphone array increases for higher frequencies). The weight for each individual microphone in the microphone array will be derived from its recorded sound level for that sub-band. This method thus results in a single overall gain correction factor for each high frequency sub-band for the sound signals recorded in the primary microphones (6). Using this method, the gain correction factors are estimated independently for each frequency sub-band.

The sound energy level for a given frequency sub-band and given direction in space can be estimated using a method that is more complicated, but also more accurate, than using the average signal energy level for the given sub-band in the secondary microphones. The average signal energy level in the secondary microphone for the given sub-band is clearly a first approximation. For a more accurate estimation, several neighbouring microphones to the given secondary microphone can be combined with the given secondary microphone in order to form a small directional acoustic receiving array. That is to say, the entire set of secondary microphones can be subdivided into smaller, possibly overlapping groups, with each group having directional properties. In fact, each small group can be considered as a Lehr-Widrow array as described in the U.S. Pat. No. 5,793,875. The microphone signals in each small group of microphones can be combined using beamforming techniques. For example, the microphone signals can be combined using a weighted summation and the resulting signal band-pass filtered as described in the U.S. Pat. No. 5,793,875. In this way, the acoustic energy in a given frequency sub-band can be determined for various directions in space in a more robust manner than just using the average signal energy levels in a given frequency sub-band for the secondary microphones.

In order to generate acoustic signals that can be played back to the listener, a synthesis filter bank, such as the TDAC synthesis filter bank is used to combine the gain-corrected signals in the different frequency sub-bands. The time signal in the low-frequency sub-bands (e.g., below 3 kHz) for the primary microphones (6) may remain unaltered or may have a time shift correction added. The gain-corrected signals in the high-frequency sub-bands are then re-combined with the time signals in the low-frequency sub-bands. This is referred to as the synthesis filtering stage. This method will produce an acoustic signal for each ear. The individualized acoustic signals can then be played over earphones in virtual auditory space or over an array of loudspeakers in the free-field using appropriate methods of inverse filtering for cross-talk cancellation of the loudspeakers.

A third method of signal processing involves mathematically identifying the individual sound sources and the direction of the individual sound sources that compose the directional sound field recorded by the microphone array. In this discussion, distinct echo signals may or may not be considered as individual sound sources separate from the original sound source. Signal processing methods such as blind signal separation using independent component analysis and/or adaptive beamforming can be used to identify the individual sound sources. In addition, methods of sub-band filtering, as described above, can be applied to the signals recorded by the microphone array prior to the sound identification process. In this case, the sub-band filtering would be followed by blind signal separation which would be applied to the signals in the different frequency sub-bands of the different microphone signals in order to either: (i) identify the individual sound sources as a whole; or (ii) identify the components of the individual sound sources corresponding to each frequency sub-band. After the sound sources composing the sound field have been identified, methods of triangulation and/or adaptive beamforming can then be used to identify the direction of the individual sound sources. The method of triangulation involves calculating the relative time-delays for a single sound source in each microphone signal. The values of the relative time-delays will determine the direction of the sound source. Alternatively, the methods of adaptive beamforming can be applied to the signals in each frequency sub-band in order to identify the correct time-delays for the different signal components corresponding to the different sound sources. In either case, once the direction of the individual sound sources have been determined, the signals corresponding to the individual sound sources can be filtered with the directional acoustic transfer functions of the external ears of the individual listener corresponding to the direction of the sound sources. These signals can then be summed in order to obtain an estimate of the sound that would have been present at the ears of the individual listener, were the individual listener to have been present at the position of the microphone array in the original sound environment. The individualized acoustic signals can then be played over earphones in virtual auditory space or over an array of loudspeakers in the free-field using appropriate methods of inverse filtering for cross-talk cancellation of the loudspeakers. As some of the echo signals would be removed by this signal processing method, it may be suited for three-dimensional sound recording/reproduction in which removing the echoes would not be a considerable problem, such as in teleconferencing and desk-top video conferencing.

The methods and equipment for recording, encoding, decoding, and reproducing a three-dimensional auditory scene for individual listeners described above have several advantages. From a psychoacoustical standpoint, research has shown that the energy levels in the high frequency sub-bands are critical for directional hearing. Research has also shown that the set of spatial directions with high gain for a given narrow high-frequency band cover a relatively wide region of space. The relative broadness of the gain patterns of the human external ears for a narrow high-frequency sub-band suggest that obtaining a moderate amount of acoustic directionality from the array of secondary microphones may be sufficient for reproducing perceptually valid three-dimensional auditory scenes. In other words, current research indicates that it is the pattern of gain and attenuation across a wide range of frequencies that is critical for spatial hearing and this is precisely what the gain corrections in the various frequency sub-bands should accomplish. In addition, recent findings and research indicate a robustness of the human auditory localization system to spectral distortion that suggests from a perceptual standpoint, a good first or second order approximation of the acoustic cues for individualized directional hearing is perceptually significant. It is thus an advantage of the invention that the accuracy of the recording and the directional information derived from the array of microphones provides a good match with the measured psychoacoustical properties of the human auditory system.

A major advantage of the method described here is that the use of gain correction factors for the high-frequency sub-bands preserves the temporal structure of the acoustic signal. In addition, it is a primary advantage that the signals in the low-frequency sub-bands are not modified and therefore will not lead to signal distortions in the time domain. Another advantage of the method is that the directional acoustic filtering properties associated with the primary microphones can be made similar to that of the human external ear by making the directional acoustic filtering structures (5) similar to the human external ear. It is an advantage of the method that the directional acoustic transfer functions of the recording device have been measured and allow for the correction or adjustment of the spatial energy gain patterns according to the differences between a given individual listener's directional acoustic transfer functions and the directional acoustic transfer functions of the recording device. It is an advantage of the method that the analysis/synthesis filter bank approach described here matches that used in all perceptual audio coding techniques and thus provides a natural interface to perceptual audio coders so that the directional aspects of the sound field can be analysed on a frequency band by frequency band basis, so that the low-frequency sub-bands maintain the correct temporal information, and so that the signals in the high-frequency sub-bands across the set of microphones can be analysed to determine the directional characteristics of the sound field.

A major advantage of the method described here is that is provides an extremely compressed encoding of microphone signals from a directional microphone array. That is to say, it provides an extremely efficient encoding of microphone signals for a plurality of microphones in a microphone array that is psychoacoustically consistent with current knowledge about the directional hearing of humans. Only the primary microphone signals have to be saved, compressed or uncompressed, in a complete fashion. The secondary microphone signals can then be decomposed in the frequency domain into sub-band signals for different frequency bands. The sub-band signals for the high-frequency sub-bands (important for directional-hearing) can be time-windowed and the energy averaged over this time window. In this way, the sample rate of the average signal energy levels for the secondary microphones is reduced by a factor related to the length of the time window. In addition, the method of employing gain correction factors for the high-frequency sub-band signals of microphones has the advantage that it provides a method to adapt a microphone signal to a different acoustic receiver in a manner that is perceptually consistent with human hearing.

A primary advantage of the encoding/decoding method described here for microphone signals from a directional microphone array is that the gain correction factors for the primary microphones can be entirely embedded in the signal decoder and not taken into account when encoding the microphone signals. This is extremely important when considering how to parallelise the process for multiple individual listeners. In other words, only the signal decoders have to enable an individualisation of the audio signals, not the signal encoders.

It is anticipated that the invention will have a wide range of applications. These would include, for example:

In the entertainment and leisure industry in the form of computer games exploiting virtual reality, in portable musical devices to generate a highly realistic listening environment over headphones; in movies where the spatial surround characteristics of the sound field can be greatly improved over traditional multi-loudspeaker placements in the cinema or home theatre.

In communications systems that involve multiple streams of auditory information delivered over headphones. The ability to separate out separate conversations is very greatly enhanced when the sources are placed in different spatial locations. This would also apply to teleconferencing and video conferencing.

In guidance and alerting systems where for instance the presence and trajectory of potential collision objects that cannot be visually appreciated can be mapped into auditory icons which occupy different locations in space.

In teleorobotics where the control of remote devices involves a virtual reality interface. The utility of such control systems is dependent on the capability of the interface to induce the sense of 'telepresence' in the operator for which the auditory system plays a key psychophysical role.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method for recording and reproducing a three dimensional auditory scene for individual listeners, the method including:

arranging a directional microphone array, comprising a plurality of microphones, such that the microphones have acoustic properties that vary with the direction of sound in space, the microphone array comprising at least one primary microphone to capture a sound field to be modified and a plurality of secondary microphones arranged about the at least one primary microphone, the secondary microphones being used to characterise directional aspects of the sound field;

determining directional acoustic transfer functions for a number of directions in space for a number of microphones in the microphone array by measuring at least one of an impulse response and a frequency response of each of the number of microphones for the number of directions in space;

determining directional acoustic transfer functions for a number of directions in space for left and right external ears of the individual listener by measuring at least one of an impulse response and a frequency response of each ear for the number of directions in space;

establishing a relative geometrical frame of reference as a function of time between the orientation and position of the external ears of the individual listener and the orientation and position of the microphone array in an original sound field at the time of the recording of the sound field; and recording a three dimensional auditory scene using the microphone array;

modifying the sound recorded by the microphone array using information derived from the differences between the directional acoustic transfer functions of the microphones in the microphone array and the directional acoustic transfer functions of the external ears of the individual listener and also directional information derived from recorded microphone signals and the geometrical frame of reference in order to perceptually improve the estimate of the sound that would have been present at the ears of the individual listener were the individual listener to have been present at the position of the microphone array and facing a specific direction in the original sound field; and collecting, arranging, and/or combining the signals intended for the left and right external ears of the individual listener into an output format and identifying these signals as a representation of a three-dimensional auditory scene that enables a perceptually valid acoustic reproduction of the sound that would have been present at the ears of the individual listener, were the individual listener to have been present at the position of the microphone array in the original sound field.

2. The method of claim 1 which includes windowing the microphone signals of the directional microphone array in the time domain.

3. The method of claim 2 which includes windowing the microphone signals of the directional, microphone array in the time domain where the time windows overlap.

4. The method of claim 1 which includes identifying and filtering any additional auditory objects with the individual listener's directional acoustic transfer functions that correspond to the relative position of the auditory object with respect to the right and left external ears of the individual listener.

5. The method of claim 4 which includes adding the signals for the left and right ear of the individual listener representing any of the additional auditory objects to the signals of the left and right ear corresponding to the estimate of the sound that would have been present at the individual listener's ears in the original sound field.

6. A method for transforming a recorded source signal, corresponding to a three-dimensional auditory scene, of a source directional acoustic receiver using information derived from signals recorded simultaneously by a directional microphone array, the directional microphone array being positioned in the same sound field as the source directional acoustic receiver and having a known geometrical arrangement with respect to the source directional acoustic receiver, so that the recorded source signal approximates the form that a recorded target signal would have if the target signal had been recorded simultaneously by a target directional acoustic receiver that has a specific geometrical arrangement as a function of time with respect to the source directional acoustic receiver, the method comprising the steps of:

arranging microphones in the directional microphone array such that there are (a) at least one primary microphone, being the source directional acoustic receiver, to capture a sound field to be modified and (b) a plurality of secondary microphones to characterise directional aspects of the sound field;

determining directional acoustic transfer functions for a number of directions in space for the source directional acoustic receiver by measuring at least one of an impulse response and a frequency response of the source directional acoustic receiver for the number of direction in space;

determining directional acoustic transfer functions for a number of directions in space for a target directional acoustic receiver by measuring at least one of an impulse response and a frequency response of the target directional acoustic receiver for the number of directions in space;

establishing a relative geometrical frame of reference as a function of time between the orientation and position of the target directional acoustic receiver and the orientation and position of the source directional acoustic receiver; and processing the sound recorded by the source directional acoustic receiver using:

(1) information derived from differences between the directional acoustic transfer function of the source directional acoustic receiver and the directional acoustic transfer functions of the target directional acoustic receiver;

(2) directional information derived from the signals recorded by the directional microphone array; and (3) the geometrical frame of reference of the target directional acoustic receiver with respect to the source directional acoustic receiver.

7. The method of claim 6 in which the target directional acoustic receiver is the external ear of an individual listener.

8. The method of claim 6 which include preparing an estimated auditory scene signal, representing the original auditory scene, as it would have been recorded by the target directional acoustic receiver in a standard audio output format and identifying the estimated auditory scene signal as a representation of a three-dimensional auditory scene.

9. The method of claim 6 in which the at least one primary microphone has directional acoustic transfer functions that vary with the direction of the sound source relative to the at least one primary microphone and the secondary microphones describe an incoming direction of acoustic energy in narrow frequency bands above approximately 1 kHz.

10. The method of claim 9 in which the at least one secondary microphone describes the incoming direction of acoustic energy with the at least one primary microphone.

11. The method of claim 9 which includes:

decomposing a recorded microphone signal into separate signals in different frequency sub-bands using an analysis filter bank and then calculating for each time window the average signal energy level, $e(ij)$, in each frequency sub-band, i, above approximately 1 to 5 kHz;

deriving gain correction factors, $gc_i(i,j)$, for the source directional acoustic receiver that indicate the difference between the gain of the source directional acoustic receiver and the gain of the target directional acoustic receiver for each frequency band, I, and each direction, j, corresponding to the direction of the at least one secondary microphone in the directional microphone array;

deriving directionality functions, $h_i$, that take into account, for a given frequency sub-band, i, and a set of secondary microphones, the degree of directionality of the collective set of secondary microphones for acoustic energy in that frequency sub-band and using the directionality functions, $h_i$, of the secondary microphones for the given frequency sub-band, i, to derive a weighted average of the gain correction factors across the directions, j, corresponding to the directions of the secondary microphones and the given frequency sub-band;

calculating overall gain correction factors, G(i), for each frequency sub-band and modifying the amplitude of the signals in the different frequency sub-bands for the source directional acoustic receiver using the overall gain correction factors;

combining the amplitude modified signals for different high-frequency sub-bands, being sub-bands greater than approximately 1 to 5 kHz for the source acoustic receiver with the estimated low-frequency signals for the target directional acoustic receiver.

12. The method of claim 9 which includes determining the average energy in a given frequency band, for a given time window, for the microphone signals in the at least one secondary microphone of the directional microphone array.

13. The method of claim 6 which includes configuring a support mount for the microphones in the directional microphone array to be a realistic and life-like acoustic mannequin and providing at least two primary microphones with the primary microphones acting as the source directional acoustic receiver and being received in external ears of the mannequin.

14. The method of claim 6 which includes selecting each of the secondary microphones from the group consisting of cardiod microphones, hypercardiod microphones, supercardiod microphones, bi-directional gradient microphones, "shotgun" microphones, and omnidirectional microphones.

15. The method of claim 6 which includes obtaining an estimate of signals in low frequency bands, being bands less than approximately 1 to 5 kHz, of the target directional acoustic receiver by using a true recording of the low-frequency signals for the target directional acoustic receiver.

16. The method of claim 6 which includes obtaining an estimate of signals in low frequency bands, being bands less than approximately 1 to 5 kHz, of the target directional acoustic receiver by deriving the signals in the low frequency bands from a signal recorded simultaneously by a microphone.

17. The method of claim 6 which includes decomposing the recorded source signal into separate signals in different frequency sub-bands

18. The method of claim 17 which includes decomposing the recorded source signal into separate signals in different frequency sub-bands using an analysis filter bank as used in multi-rate digital signal processing.

19. The method of claim 6 in which the recorded microphones signals are processed by filtering the signals with the directional acoustic transfer functions of the target directional acoustic receiver that correspond to the directions in which the microphones are pointing in space and then summing these signals to obtain an estimate of the sound that would have been recorded by the target directional acoustic receiver.

20. The method of claim 6 in which the signals recorded by the directional microphone array are processed to determine the individual sounds composing the sound field; applying predetermined techniques to determine the direction of the individual sound sources; and filtering identified individual sound sources with the directional acoustic transfer functions of the target directional acoustic receiver corresponding to the identified direction of the sound sources.

21. The method of claim 20 which includes processing the signals recorded by the directional microphone array using blind signal separation methods.

22. The method of claim 20 which includes selecting the techniques to determine the direction of the individual sound sources from at least one of adaptive beam-forming and triangulation.

23. The method of claim 6 which includes processing signals of additional auditory objects with the directional acoustic transfer functions of the target directional acoustic receiver and adding the processed signals representing the additional auditory objects to an estimated target acoustic receiver signal

24. The method of claim 6 which includes windowing the microphone signals of the directional, microphone array in the time domain

25. The method of claim 24 which includes windowing the microphone signals of the directional, microphone array in the time domain where the time windows overlap.

* * * * *